US009869076B1

(12) United States Patent
Harris

(10) Patent No.: US 9,869,076 B1
(45) Date of Patent: Jan. 16, 2018

(54) COMBINATION SINK STRAINER AND STOPPER

(71) Applicant: Michael Harris, Dayton, OH (US)

(72) Inventor: Michael Harris, Dayton, OH (US)

( * ) Notice: Subject to any disclaimer, the term of this patent is extended or adjusted under 35 U.S.C. 154(b) by 0 days.

(21) Appl. No.: 15/390,308

(22) Filed: Dec. 23, 2016

(51) Int. Cl.
*A47K 1/14* (2006.01)
*E03C 1/262* (2006.01)
*E03C 1/23* (2006.01)

(52) U.S. Cl.
CPC ..... *E03C 1/262* (2013.01); *E03C 1/2302* (2013.01); *E03C 2001/2311* (2013.01)

(58) Field of Classification Search
CPC ..... E03C 1/26; E03C 1/262
USPC ..... 4/286, 287
See application file for complete search history.

(56) References Cited

U.S. PATENT DOCUMENTS 181,265 A * 8/1876 Hodges ..... E03C 1/262 4/287
1,961,277 A * 6/1934 Busse ..... A47K 1/14 4/287
2,166,273 A * 7/1939 Ulmer ..... E03C 1/262 210/164
2,348,093 A * 5/1944 Pasman ..... E03C 1/23 251/280
5,724,684 A * 3/1998 Paar ..... E03C 1/26 4/286
7,517,452 B2 * 4/2009 Chapman ..... B01D 29/35 210/163

* cited by examiner

*Primary Examiner* — Huyen Le
(74) *Attorney, Agent, or Firm* — R. William Graham

(57) ABSTRACT

A combination sink strainer and stopper for a sink having a predefined sink opening through which fluid and limited waste passes includes a strainer cup having a continuous sidewall and a bottom connected to said sidewall, a strainer cup including a plurality of openings therethrough to provide a straining of debris over a predetermined size of the openings and a cover plate pivotally connected to the strainer cup which when the strainer cup is disposed in the sink opening, the cover plate is permitted to pivot to a first closed position and close and cover the strainer cup in a manner to seal about the sink opening and a second open position wherein the strainer cup is at least partially not covered by said cover plate and permit fluid and the limited waste therethrough.

8 Claims, 6 Drawing Sheets

COMBINATION SINK STRAINER AND STOPPER

BACKGROUND OF INVENTION

Field of the Invention

The instant invention relates to sinks. More particularly, the invention relates to a a combination sink strainer and stopper.

Related Art

There exist a variety of combination strainer and stopper devices for use in a conventional sink. A popular one which exists is a strainer having a housing with a plurality of predefined openings and which includes a central shaft extending upward through a hole in the strainer and has a lower end fixed to a plate which includes a plurality of complementary formed predefined openings which can align with the predefined openings of the housing upon rotation thereof and thereby provide for fluid to pass therethrough when so aligned.

While this type of traditional combination strainer stopper has been widely used, there is improvement needed. This type of strainer tends not to adequately seal over time and thus stops in its intended use of being a stopper as well.

Other improvements on such prior devices include integrating brush or scrubbers on the strainer and stopper.

SUMMARY OF INVENTION

It is an object to improve sinks.

It is another object to improve sink strainers.

Another object is to improve a combination sink strainer and stopper.

Accordingly, the invention is directed to a combination sink strainer and stopper for a sink having a predefined sink opening through which fluid and limited waste passes. The combination sink strainer and stopper includes a strainer cup having a continuous sidewall and a bottom connected to the sidewall, a strainer cup including a plurality of openings therethrough to provide straining for debris over a predetermined size of the openings and a cover plate pivotally connected to the strainer cup which when the strainer cup is disposed in the sink opening, the cover plate is permitted to pivot to a first closed position and close and cover the strainer cup in a manner to seal about the sink opening and a second open position wherein the strainer cup is at least partially not covered by the cover plate and permit fluid and the limited waste therethrough.

The cover plate can include a magnetic seal, which cab preferably be disposed about the periphery of the cover plate. The combination cover plate and the sink strainer can preferably include limited axial displacement relative to each other.

DETAILED DESCRIPTION OF A PREFERRED EMBODIMENT

Figure 1:
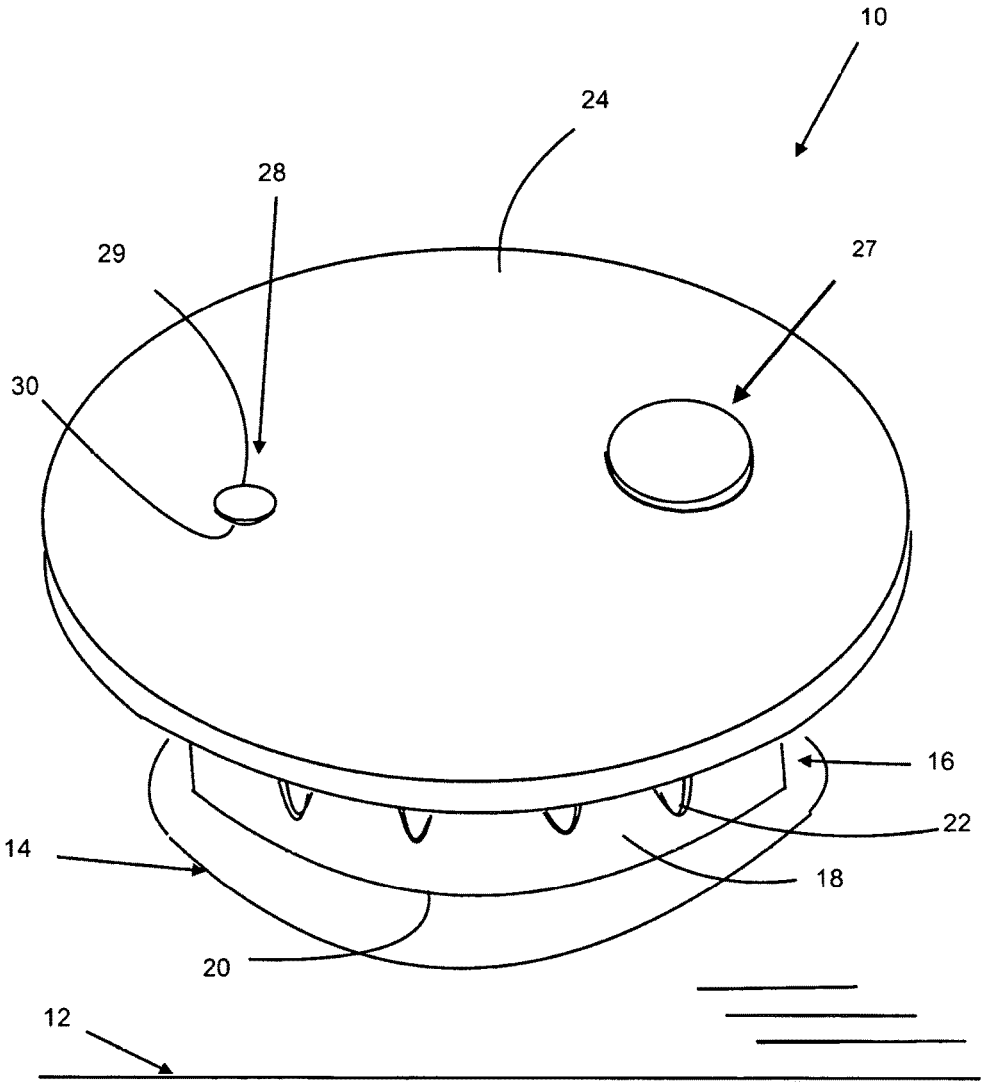
FIG. 1 is a top perspective view of the invention.
Figure 2:
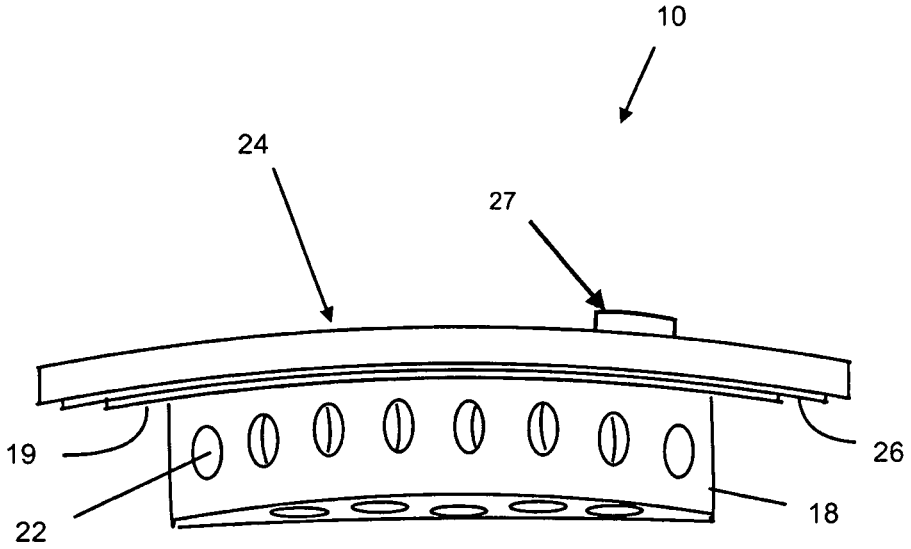
FIG. 2 is a side perspective view of the invention in an open mode.
Figure 3:
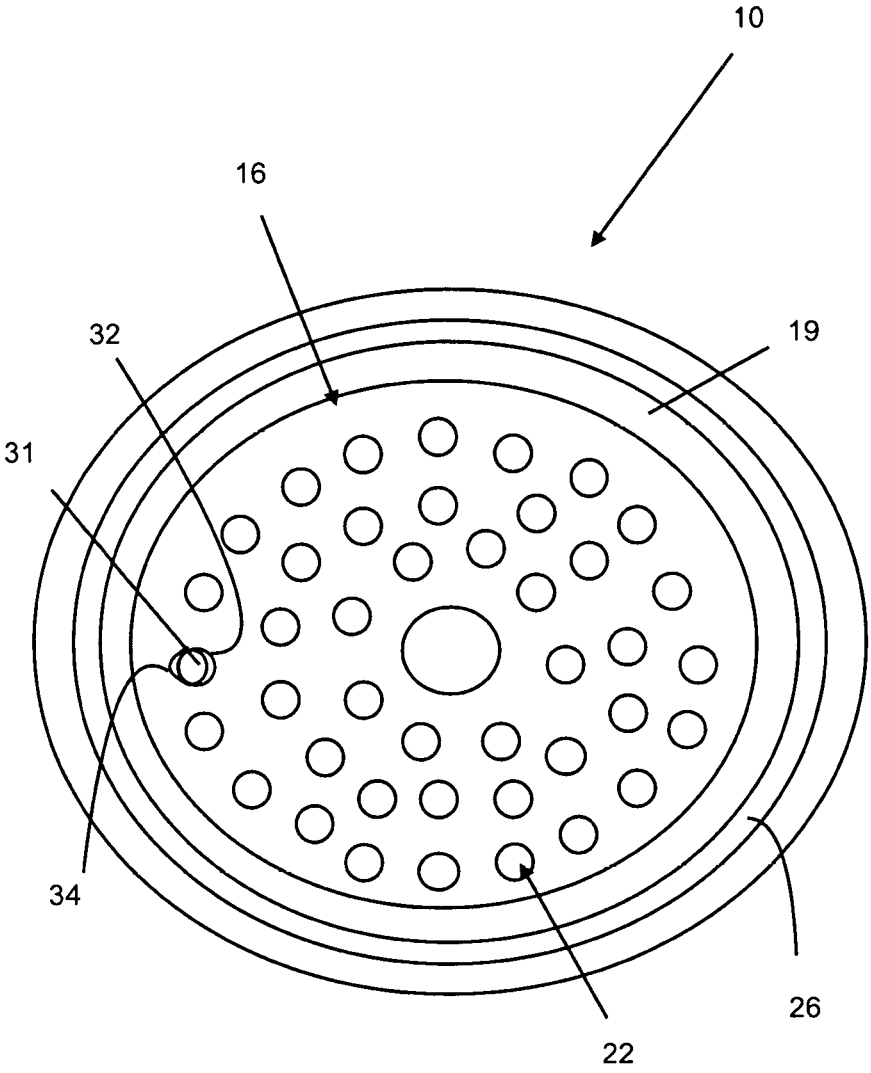
FIG. 3 is a bottom view of the invention is a closed mode.

Referring now to the drawings, the combination sink strainer and stopper of the instant invention is generally designated by the numeral 10. The combination sink strainer and stopper 10 is shown for use in a sink 12 having a predefined sink opening 14 through which fluid and limited waste passes. The combination sink strainer and stopper 10 includes a strainer cup 16 having a continuous sidewall 18, upper radially outward extending collar 19 and a bottom 20 connected to the sidewall 18. The strainer cup 16 includes a plurality of openings 22 therethrough to provide straining for debris over a predetermined size of the openings 22.

There is also provided a cover plate 24 pivotally connected to the strainer cup 16 which when the strainer cup 16 is disposed in the sink opening 14, the cover plate 24 is permitted to pivot to a first closed position and close and cover the strainer cup 16 in a manner to seal about the sink opening 14 and to a second open position wherein the strainer cup 16 is at least partially not covered by the cover plate 24 and permits fluid and the limited waste therethrough.

Figure 4:
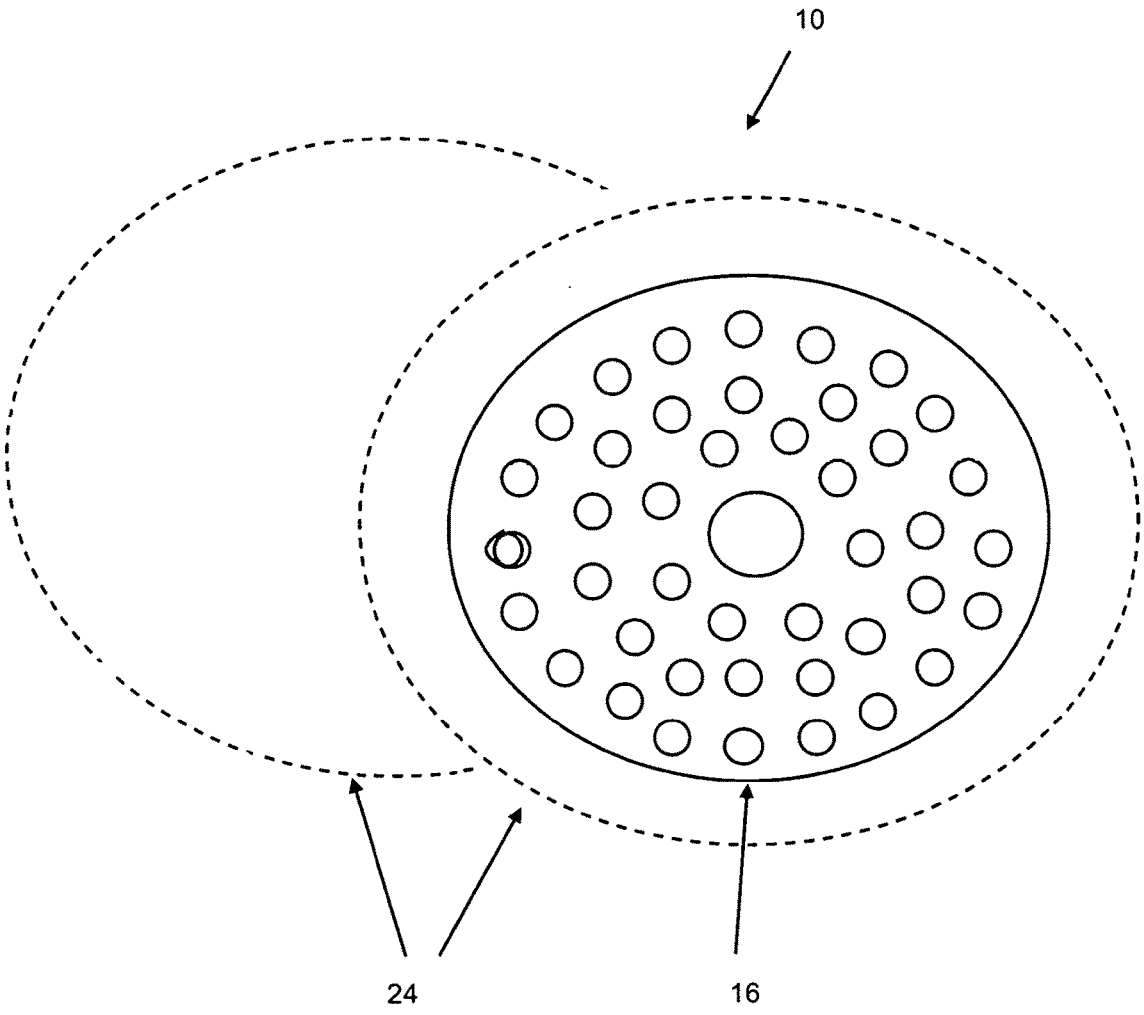
FIG. 4 is a bottom view depicting open and closed positions of the invention.
Figure 5:
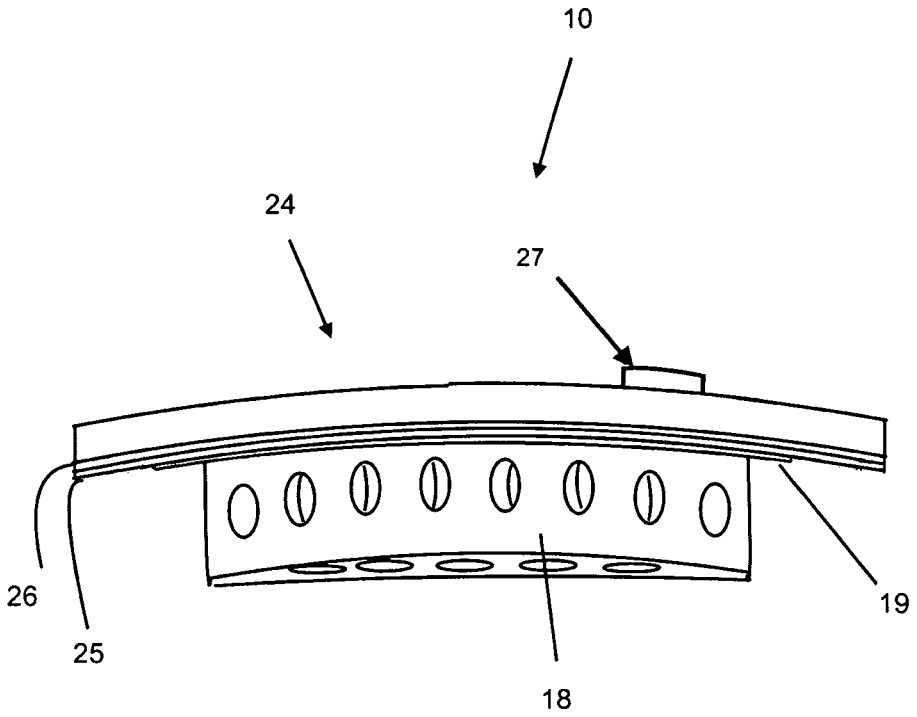
FIG. 5 depicts an alternative embodiment.
Figure 6:
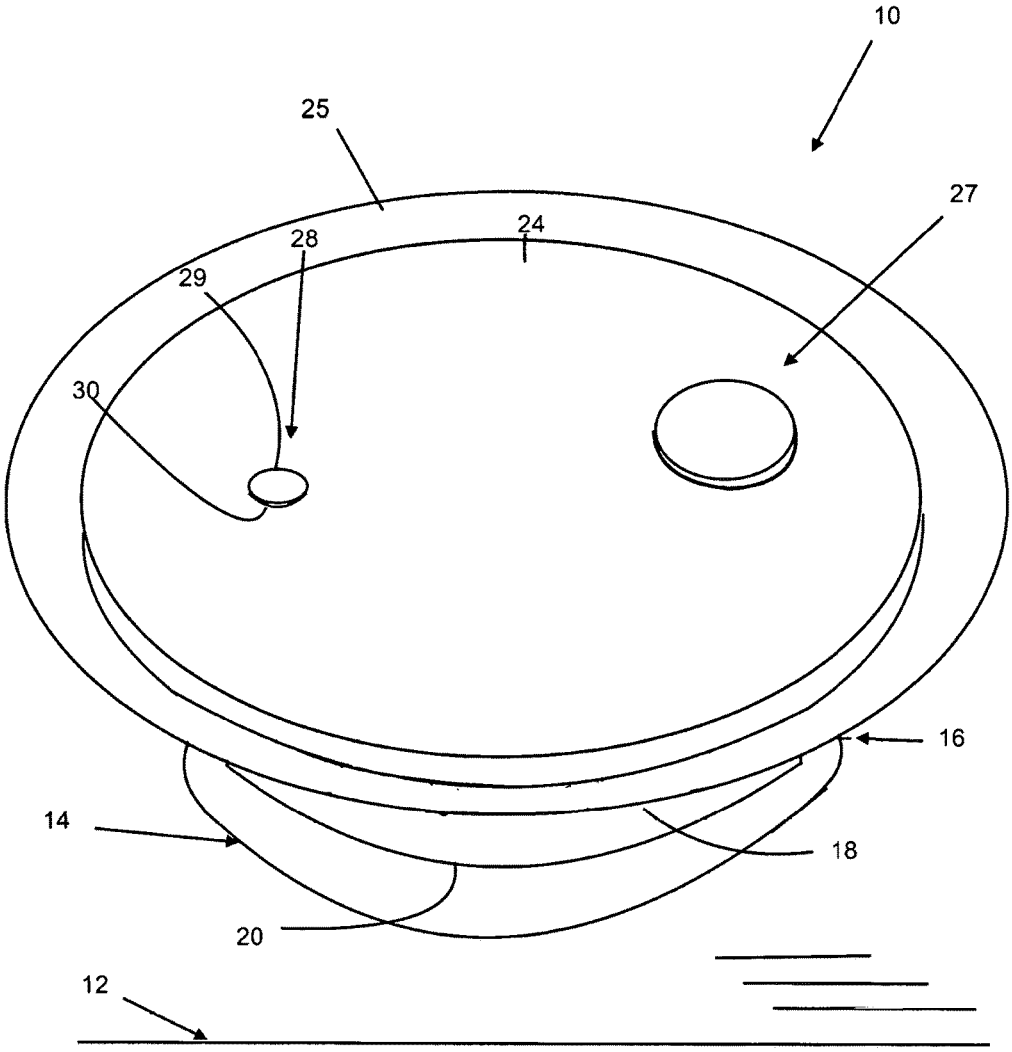
FIG. 6 depicts still another embodiment of the invention.

The cover plate 24 can include a seal 26, which can preferably be disposed about the periphery of the cover plate 24. The cover plate 24 include a magnetic material or optionally the seal 26 can include a magnetic material. The magnetic material can span across a periphery of opening 14, e.g. about 3.2 to 4.5 inches. A rubber gasket 25 can also be employed between the seal 26 and plate 24 in the case where the seal 26 is magnetic. The gasket 25 can be of a diameter larger than the opening 14 to cover the opening in a manner to seal thereabout. The gasket 25 can also optionally include a magnetic material. The cover plate 24 can be made of materials such as acrylic, plastic, rubber or metal, for example. The size of the combination strainer and stopper 10 can be of a conventional sizing with the strainer cup 16 to fit within the opening 14 while the cover plate 24, gasket 25 and seal 26 are larger than the opening 14 to seal thereabout to the surface of the sink 12. It is contemplated the diameters of each may vary slightly to accommodate covering the opening 14. The cover plate 24 and the sink strainer cup 16 can preferably include limited axial displacement relative to each other. The cover plate 24 and sink strainer cup 16 can be held together by a pivot pin 28 having a head 29 larger than opening 30 and elongated stem 31 which extends through an opening 30 in the cover plate 24 and an opening 32 of strainer cup bottom 20. A C-clip 34 or other connected retainer the end of stem 31 of pin 28 in place. The combination sink strainer and stopper 10 can be made of metal or other suitable material. FIG. 4 depicts in dotted lines the cover plate 24 positions moving between an open to a closed position by using a knob 27 mounted to the cover plate 24.

Other modifications, derivations and improvements will be readily apparent to those skilled in the art. Accordingly, the appended claims hereto should be afforded the coverage of such modifications, derivations and improvements.

What is claimed is:

1. A combination sink strainer and stopper for a sink having a predefined sink opening through which fluid and limited waste passes, which includes:

a strainer cup having a continuous sidewall and a bottom connecting to and between said sidewall, said strainer cup including a plurality of openings therethrough to provide straining for debris over a predetermined size of said openings; and a cover plate pivotally connected to said strainer cup and including a magnetic material extending entirely along a periphery thereof and adjacent said strainer cup which when said strainer cup is disposed in the sink opening, said cover plate is permitted to pivot to a first closed position and close and cover said strainer cup in a manner such that said magnetic material seals about the sink opening and a second open position wherein said strainer cup is at least partially not covered by said cover plate and permits fluid and the limited waste therethrough.

2. The combination sink strainer and stopper of claim 1, wherein said cover plate and said sink strainer include limited axial displacement relative to each other.

3. The combination sink strainer and stopper of claim 1, wherein said strainer cup includes an upper radially extending collar connecting to said sidewall and extending partially into said magnetic material but not entirely to the outer periphery thereof.

4. The combination sink strainer and stopper of claim 3, which includes a seal connected to said collar.

5. The combination sink strainer and stopper of claim 1, wherein said magnetic material is characterized to be an annular seal including said magnetic material.

6. The combination sink strainer and stopper of claim 5, which includes an annular rubber gasket interconnecting said seal and said cover plate.

7. The combination sink strainer and stopper of claim 6, wherein said rubber gasket is larger than the sink opening.

8. The combination sink strainer and stopper of claim 1, which further includes a knob connected to said cover plate.

* * * * *